US006007305A

United States Patent [19]

Maloney et al.

[11] Patent Number: 6,007,305

[45] Date of Patent: Dec. 28, 1999

[54] INTERNAL COMBUSTION ENGINE WITH INTEGRAL CRANKSHAFT DRIVEN PUMP

[75] Inventors: Ronald P. Maloney, Peoria; Charles R. Miller, Metamora; Scott F. Shafer, Morton, all of Ill.

[73] Assignee: Caterpillar Inc., Peoria, Ill.

[21] Appl. No.: 08/964,958

[22] Filed: Nov. 5, 1997

Related U.S. Application Data

[60] Provisional application No. 60/034,826, Dec. 19, 1996.

[51] Int. Cl.[6] ..... F04B 1/00

[52] U.S. Cl. ..... 417/273; 417/364

[58] Field of Search ..... 417/273, 269, 417/364, 470; 92/129

[56] References Cited

U.S. PATENT DOCUMENTS

| | | | |
|---|---|---|---|
| 1,892,443 | 12/1932 | Winslow | 92/129 |
| 2,345,125 | 3/1944 | Huber | 74/50 |
| 2,818,816 | 1/1958 | Christenson | 103/174 |
| 3,584,610 | 6/1971 | Porter | 123/55 AA |
| 4,313,714 | 2/1982 | Kubeczka | 417/273 |
| 4,339,988 | 7/1982 | Steele | 91/493 |
| 4,645,428 | 2/1987 | Arregui et al. | 417/273 |
| 4,874,297 | 10/1989 | Collins et al. | 417/265 |
| 4,968,220 | 11/1990 | Filippi et al. | 417/273 |
| 4,975,025 | 12/1990 | Yamamura et al. | 417/273 |
| 5,033,940 | 7/1991 | Baumann | 417/273 |
| 5,090,295 | 2/1992 | Cunningham et al. | 91/491 |
| 5,180,292 | 1/1993 | Abousabha et al. | 417/273 |
| 5,280,745 | 1/1994 | Maruno | 91/477 |
| 5,584,672 | 12/1996 | Simonette | 417/307 |
| 5,884,608 | 3/1999 | Cooke | 123/495 |

FOREIGN PATENT DOCUMENTS

| | | | |
|---|---|---|---|
| 590 362A1 | 8/1993 | European Pat. Off. | F02M 39/02 |
| 4237049A1 | 5/1993 | Germany | F04B 1/04 |
| 4216487A1 | 11/1993 | Germany | F04B 1/04 |
| 3-81574 | 8/1989 | Japan | F04B 1/04 |
| 181354 | 6/1922 | United Kingdom . | |
| 205809 | 10/1923 | United Kingdom . | |
| 348980 | 9/1930 | United Kingdom . | |
| 433024 | 7/1935 | United Kingdom . | |
| 433022 | 8/1935 | United Kingdom . | |
| 433024 | 8/1935 | United Kingdom . | |
| 348980 | 6/1991 | United Kingdom . | |
| 92/14056 | 8/1992 | WIPO . | |
| 93/24346 | 12/1993 | WIPO . | |

*Primary Examiner*—Charles G. Freay
*Assistant Examiner*—Robert Z. Evora
*Attorney, Agent, or Firm*—Alan J. Hickman

[57] ABSTRACT

An engine including a crankshaft having a crankshaft pump portion including at least one cam lobe for operably engaging a pump integral to the engine block of the engine, such that the pump is actuated directly by the crankshaft pump portion, thereby eliminating the typical drive train so as to reduce weight of the pump and engine combination while enhancing the reliability thereof and improving pump efficiency.

25 Claims, 2 Drawing Sheets

Fig. 1.
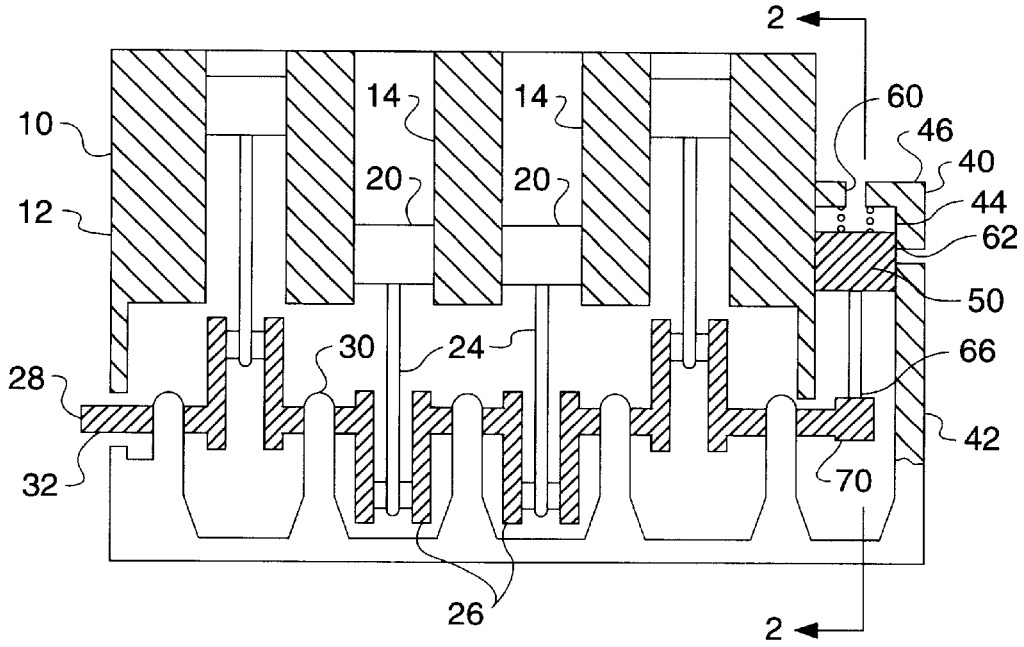
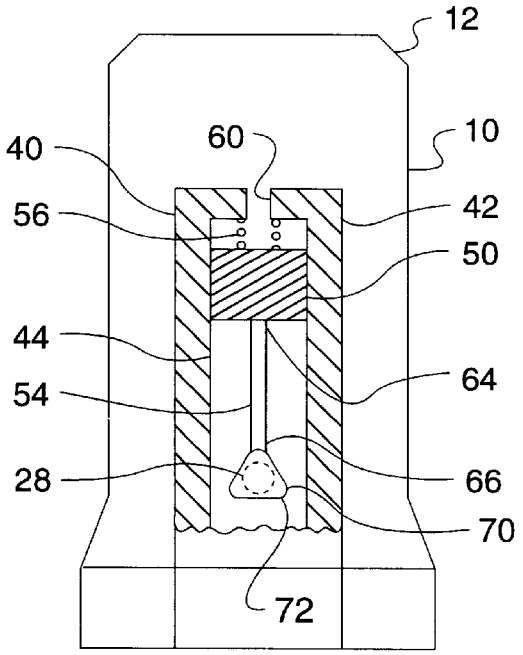
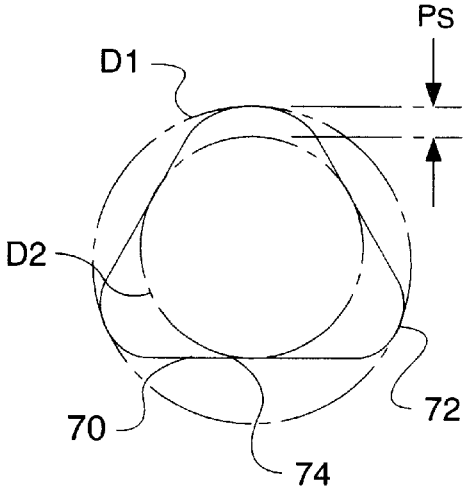
Fig. 2.
Fig. 3.

Fig-4-
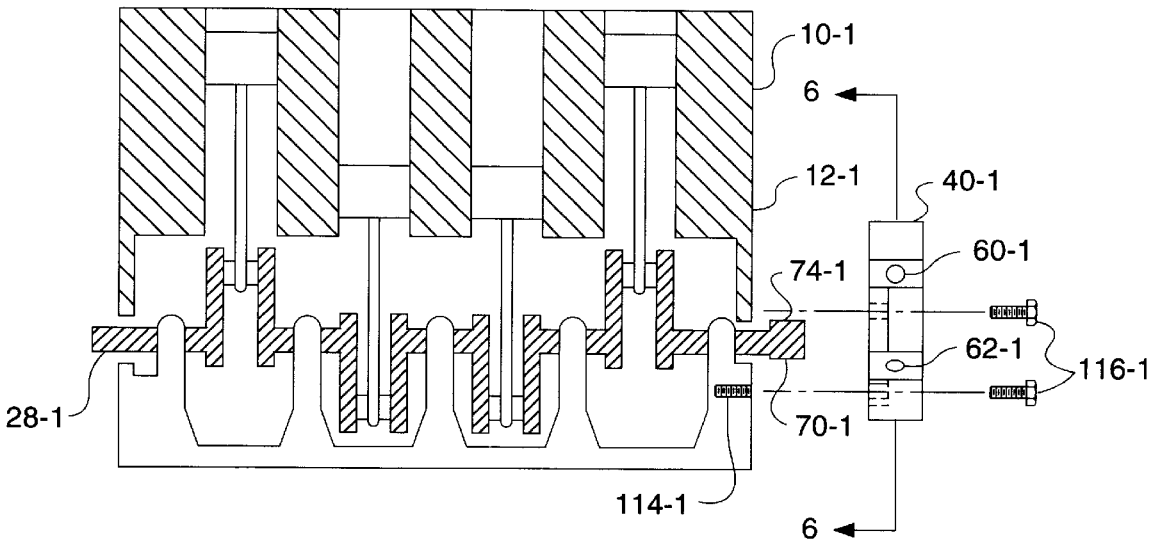
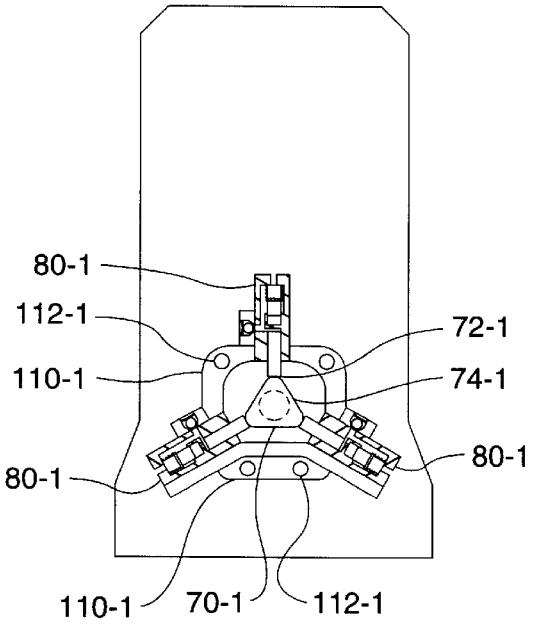
Fig-6-
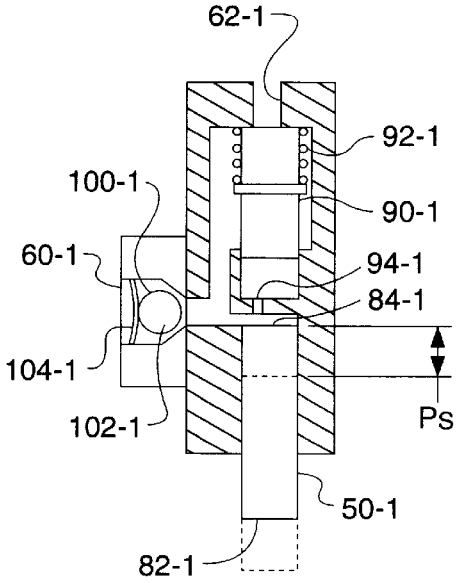
Fig-5-

INTERNAL COMBUSTION ENGINE WITH INTEGRAL CRANKSHAFT DRIVEN PUMP

CROSS REFERENCE TO RELATED APPLICATIONS

This application is based, in part, on the material disclosed in U.S. provisional patent application Ser. No. 60/034,826 filed Dec. 19, 1996.

TECHNICAL FIELD

This invention generally pertains to internal combustion engine apparatus, and more particularly to apparatus and equipment for operating hydraulic or high pressure pumping apparatus in conjunction with internal combustion engines.

BACKGROUND ART

In many applications, it is typical to operate hydraulic or fluid pumping apparatus in conjunction with an internal combustion engine as the prime mover for operating the pump. In many of these applications, the internal combustion engine serves as the prime mover for powering a vehicle or automotive application in which hydraulic functions are also desired. In these applications, the hydraulic functions are secondary to the use of the internal combustion engine as prime mover. Furthermore, in these applications, the hydraulic pump is typically an "on-demand" system, which is operated continually so as to provide a readily available source of hydraulic power.

The pump is typically operated continuously by means of a drive train connected to the prime mover. Typically, the drive train will be a series of gears connected to the prime mover crankshaft, a belt and pulley arrangement with cooperating pulleys arranged on the pump driveshaft and the prime mover crankshaft with a belt operating there between, or a chain and sprocket arrangement operating similarly with a chain between corresponding sprockets on the prime mover's crankshaft and the hydraulic pump. These different drive train arrangements are suitable and different applications, depending upon the power to be transmitted by the drive train, and the operating environment in which the drive train is to be employed. However, these drive train arrangements also share common disadvantages. One disadvantage is the increased expense inherent in providing the drive train apparatus, including the cost of assembling the drive train. Another disadvantage common to these drive trains lies in the increased maintenance requirement necessitated by the maintenance of the bearings of the gears, or the drive belts or chains used in the drive trains. Another disadvantage, particularly applicable to vehicular and automotive applications, lies in the increased size and weight of the hydraulic system incorporating such a drive train arrangement. Furthermore, a failure of such typical drive train arrangements can cause the failure of the hydraulic system, leading to undesirable downtime and increased maintenance costs, with overall reduced reliability of the apparatus in which the drive train arrangement is employed.

Therefore, it is an object of the present invention to provide such a hydraulic system as will have increased reliability.

It is another object of the present invention to provide such a hydraulic system as will have a relatively lower manufacturing cost.

It is yet another object of the present invention to provide such a hydraulic system as will have an improved ease of installation.

It is yet a further object of the present invention to provide such a hydraulic system as will have a relatively lower cost of operation.

It is yet a further object of the present invention to provide such a hydraulic system as will have relatively reduced maintenance costs in operation.

It is yet a further object of the present invention to provide such a hydraulic pump system as will have a relatively reduced size and weight suitable for use in vehicular and automotive applications.

These and other objectives of the present invention will become apparent in the specifications and claims that follow.

SUMMARY OF THE INVENTION

The subject invention is an internal combustion engine block having as an integral component a pump, such that the crankshaft of the internal combustion engine includes a lobed pump-driving portion which acts as a camshaft in the pump for operating the pump concurrently with the internal combustion engine.

BRIEF DESCRIPTION OF THE DRAWINGS

FIG. 1 shows a partial cross-sectional view of an internal combustion engine block including a crankshaft and pump according to the present invention.

FIG. 2 shows a partial cross-sectional view of an internal combustion engine block taken along Section line 2—2 of FIG. 1.

FIG. 3 shows an enlarged view of the crankshaft pump portion according to the present invention.

FIG. 4 shows a partial cross-sectional view of an internal combustion engine block including a crankshaft and pump according to an alternative embodiment of the present invention.

FIG. 5 shows an enlarged cross-sectional view of a pump unit subassembly according to the alternative embodiment of the present invention, taken along Section line 6—6 of FIG. 4.

FIG. 6 shows a partial cross-sectional view of a pump integral with an internal combustion engine block including a crankshaft according to the alternative embodiment of the present invention, taken along Section line 6—6 of FIG. 4.

DESCRIPTION OF THE PREFERRED EMBODIMENT

A partial view of an internal combustion engine 10 including the present invention is disclosed in FIG. 1 and generally referred to by the reference number 10.

The partial engine 10 includes an engine block 12 in which is defined at least one, and preferably a plurality of vertical, in-line cylindrical cylinder walls 14, or as is shown, for in-line cylinders as is typical for a four-cylinder engine as is commonly known to those in the art. Within each cylinder wall 14 is operably disposed a piston 20 for reciprocating operation therein. Each piston 20 is connected by a connecting rod 24 to a crankshaft offset portion 26 of a crankshaft 28. The crankshaft 28 is longitudinally disposed within the engine block 12 so as to parallel the in-line cylinder walls 14. This operably places the crankshaft offset portion 26 adjacent the respective cylinder wall 14 and piston 20 such that the crankshaft offset portions 26 are spaced apart along the crankshaft 28. Adjacent each crankshaft offset portion 26 is a crankshaft support means 30 for operably securing the crankshaft 28 to the engine block 12 to permit rotational motion of the crankshaft 28 while ensuring that the crankshaft 28 remains in a fixed placement relative to the engine block 12. The crankshaft 28 also includes a crankshaft output portion 32 which extends transversely from the engine block 12 for engaging a powered device (not shown) by transmitting power generated within the internal combustion engine 10 to a transmission or drive train, or other application in which the engine 10 may desirably be employed.

The partial internal combustion block 10, as will be understood by those skilled in the art, is intended to exemplify an engine 10 in which the present invention may be suitably employed. Those skilled in the art will readily appreciate that the engine block 10 does not include the various apparatus and components necessary or desirable for proper operation of a complete engine 10. For example, the complete typical engine apparatus includes a cylinder head sub-assembly, including valves and apparatus for operating the valves in the appropriate open and closed timed operation, internal lubrication apparatus for providing lubrication to the various components of a typical engine apparatus, and includes cooling means typically for providing liquid cooling of the components of an engine apparatus. Furthermore, the engine block 12 does not include the apertures and voids typically found in such engine apparatus to accommodate the lubrication and cooling apparatus and fluids. Those skilled in the art, however, will readily appreciate that the inclusion of such various apparatus does not affect the application of the present invention to the internal combustion engine 10. Therefore, since these other various apparatus are considered to be well known in the art, they are not further discussed herein.

Turning then to FIGS. 1 and 2, the present invention is more clearly disclosed in connection with the engine 10. The engine block 12 is provided with an integral pump 40. For purposes of simplicity, the pump 40 is shown disposed at the end of the engine block 12 opposite the end including the crankshaft output portion 32. However, by varying the spaces between the respective cylinder walls 14, the integral pump 40 could be placed at any convenient location within the engine block 10. The integral pump 40 includes a pump housing 42 providing a pump cylinder wall 44 therein, the pump cylinder wall 44 preferably being in line with the cylinder walls 14. A pump head 46 is disposed on the upper end of the pump housing 42. A pump piston 50 is disposed within the pump cylinder wall 44 for reciprocating operation therein, and the pump piston 50 together with the pump cylinder wall 44 and the pump head 46 defines a pumping chamber for pressurizing a pumped fluid. The pump piston 50 is operably responsive to a pump piston actuator 54. A pump piston spring means 56 is provided within the pump 40 for urging the pump piston 50 away from the pump head 46 and toward the crankshaft 28. The pump head 46 is provided with an outlet aperture 60 for permitting an outflow of pumped fluid, and the pump housing 44 is provided with a pump inlet aperture 62 for permitting an inflow of fluid into the pump chamber.

The pump piston actuator 54 engages the pump piston 50 at the actuator proximate end 64, and the actuator distal end 74 engages a crankshaft pump portion 70. The crankshaft portion 70 is provided with at least one cam lobe 72 in sliding engagement with the actuator distal end 74. The crankshaft cam lobe 72, as shown in FIG. 3, functions as a circle having an effectively varying radius with respect to the pump piston actuator 54, to actuate the pump piston actuator 54 and the pump piston 50 through a stroke Ps corresponding to the difference between the maximum effective diameter D1 and the minimum effective diameter D2 of the crankshaft pump portion 70.

According to the preferred embodiment, the crankshaft pump portion 70 may be provided with a plurality of cam lobes 72. Each cam lobe 72 includes a cam lobe distal surface 74 at a relatively greater radius defining a relatively larger effective diameter D1, with a cam lobe proximate surface 76 at a relatively lesser radius defining a relatively smaller effective diameter D2 between each of the cam lobe distal surfaces 74. The pump effective stroke Ps is the difference between the radius of the larger effective diameter D1 of the cam lobe distal surface 74 and radius of the smaller effective diameter D2 of the cam lobe proximate surface 76.

In operation, the crankshaft 28 of the engine 10 rotates in the engine block 12 as the engine is operated for producing power to the crankshaft output portion 32. The crankshaft pump portion 70 rotates with the crankshaft 28, causing the crankshaft cam lobes 72 to rotate. The piston pump actuator 54 is constrained to reciprocating linear motion with respect to the crankshaft pump portion 70, and follows the crankshaft pump portion 70 as it rotates. The piston pump actuator 54 reciprocates through the pump stroke Ps as it follows the cam lobes 72 from the cam lobe distal surface 74 to the cam lobe joining surface 76 and again to the cam lobe distal surface 74. As the piston pump actuator 54 reciprocates in conjunction with the changing radii of the effective diameters D1 and D2, the piston pump also reciprocates in the pump stroke Ps with the piston pump spring means 56 maintaining the piston pump 50 in connection with the actuator proximate end 64. Where the crankshaft portion 70 includes three cam lobe distal surfaces 74 as shown in the preferred embodiment herein, the pump piston 50 will be actuated through three reciprocating pump strokes Ps for each rotation of the crankshaft 28.

During each pump stroke Ps, the fluid to the pump will be received through the pump inlet aperture 62 and forced out the pump outlet aperture 60 by the action of the pump piston 50. As known to those skilled in the art, the integral pump 40 would typically be connected to various hydraulic flow apparatus such as a hydraulic load and a fluid supply and would further include various valves and check valves for ensuring the appropriate flow of the fluid within the hydraulic system. Hydraulic systems as such are generally believed to be well known and need not be disclosed herein, since the integral pump 40 would satisfactorily be applied to a variety of applications.

There are alternative embodiments of the subject invention which may be devised within the scope and spirit of the description and following claims. It should be noted that when the same item or feature is shown in more than one embodiment, it will be labeled with the corresponding reference numeral to aid in the understanding of the subject invention. Furthermore, reference should be had to all of the Figures necessary to aid in the understanding of the specification even where a particular Figure is referred to, as all reference numerals are not displayed in all Figures in order to minimize confusion and aid in clarifying the subject invention.

Turning then to FIGS. 4, 5, and 6, an alternative preferred embodiment is disclosed wherein the integral pump 40-1 is a multiple cylinder radial piston pump separable from the block 12-1. The pump 40-1 includes a plurality of piston unit subassemblies 80-1, each piston unit having a pump outlet aperture 60-1 and a pump inlet aperture 62-1 for permitting an outflow of pumped fluid and an inlet for fluid to be pumped, respectively, as with the preferred embodiment.

Each pump unit 80-1 includes a piston 50-1 which has a distal end 82-1 in direct contact with and directly responsive to the crankshaft pump portion 70-1 operating through the pump stroke Ps, as described above, and a proximate end 84-1 for acting directly upon the fluid to be pumped. A pump inlet valve 90-1 is provided for permitting an inflow of fluid through the pump inlet aperture 62-1 and preventing an outflow of fluid through the pump inlet aperture 62-1. A pump inlet valve spring means 92-1 is provided for urging the pump inlet valve 90-1 to the flow permitting position, and a pressure aperture 94-1 is provided for pressurizing the pump inlet valve 90-1 to the flow preventing position during pumping by the pump piston 50-1. Similarly, in the outlet aperture 60-1, a pump outlet valve 100-1 is provided for permitting an outflow of pumped fluid from the pump unit 80-1. The outlet check valve 100-1 includes a movable ball 102-1 and a spring means 104-1 for urging the ball 102-1 to the closed, flow preventing position, the outlet valve spring means 104-1 being overcome by the force of pumped fluid to permit flow from the pump unit 80-1.

The pump 40-1 includes three of the pump units 80-1, although as those skilled in the art will recognize, it is possible to employ a greater or lesser number of such pump units 80-1 in a radial-type pump design. Furthermore, those skilled in the art will recognize that a wide variety of pump units such as that exemplified by the pump unit 80-1 are available to be employed in radial-type piston pumps, and that the pump unit itself does not comprise the subject invention.

The pump 40-1 further includes mounting flanges 110-1 having mounting bores 112-1 therethrough. As shown in FIG. 4, the mounting bores 112-1 align with block mounting bores 114-1 such that the pump 40-1 may be mounted against the engine block 12-1 and securing bolts 116-1 secure the pump 40-1 for operation concurrent with the rotation of the crankshaft 28-1. When the pump 40-1 is secured to the engine block 12-1, the pump pistons 50-1 engage the crankshaft pump 70-1. In operation, the pump 40-1 of the alternative embodiment operates in a manner substantially similar to that of the preferred embodiment, with each pump unit 80-1 causing the pumping of fluid in response to the rotation of the crankshaft pump portion 70-1. Furthermore, the crankshaft 28 may be provided with more than one crankshaft pump portion 70 disposed along the crankshaft 28. Each such crankshaft pump portion 70 would then be able to drive an individual pump 40 such as the pump unit subassembly 40-1 for providing pumped fluid suitable for use in various different applications.

As can be seen, numerous advantages attain to the internal combustion engine 10 including the present invention therein. One advantage is substantially simplified drive train involved in operating the pump or pump units of a hydraulic system. Another advantage is the ease of assembly and reduced manufacturing cost achieved by the present invention, since the drive train of gears or belts and pulleys typically required for pump operation is eliminated. The elimination of the drive train is also advantageous in providing increased reliability and reduced maintenance of an engine 10 including such a pump 40 due to the reduction in the number of components required in the present invention. Furthermore, the inclusion of the pump into the engine 10 and the elimination of the drive train typically required provides a reduction in the weight and space required for the present invention as compared to the typical pump and engine combination. Finally, the present invention is readily adapted to a wide variety internal combustion engines and types of pump mechanisms requiring only a rotating crankshaft 28 with a crankshaft pump portion 70 and a pump 40 linearly responsive thereto. Therefore, it can be seen that the present invention is a substantial improvement over the prior art.

Modifications to the preferred embodiment of the subject invention will be apparent to those skilled in the art within the scope of the claims that follow:

What is claimed is:

1. A crankshaft for an internal combustion engine having an engine block, comprising:

a crankshaft offset portion for operably engaging a piston connecting rod;

an output portion for engaging a powered device;

a crankshaft pump portion including a cam lobe for actuating a pump piston for pumping a fluid, said crankshaft offset portion, said output portion, and said crankshaft pump portion being formed integral and in one-piece.

2. The crankshaft as set forth in claim 1 wherein said crankshaft pump portion further includes a cam lobe distal surface at a relatively larger radius and a cam lobe proximate surface at a relatively lesser radius.

3. The crankshaft as set forth in claim 2 wherein said crankshaft pump portion further includes a plurality of said cam lobe distal surfaces and said cam lobe proximate surfaces.

4. The crankshaft as set forth in claim 3 wherein said crankshaft pump portion is disposed within said engine block.

5. The crankshaft as set forth in claim 3 wherein said crankshaft pump portion extends from said engine block.

6. An engine block having a cylinder wall for an internal combustion engine, said engine block comprised of:

a means for rotationally securing a crankshaft in said engine block;

an integral pump including a pump piston for pumping a fluid;

the crankshaft rotationally secured in said crankshaft securing means; said crankshaft including:

a crankshaft offset portion for operably engaging a piston connecting rod;

an output portion for engaging a powered device;

a crankshaft pump portion including a cam lobe for reciprocally actuating said pump piston, said crankshaft offset portion, said output portion, and said crankshaft pump portion being formed integral and in one-piece.

7. The engine block as set forth in claim 6 wherein said crankshaft pump portion further includes a cam lobe distal surface at a relatively larger radius and a cam lobe proximate surface at a relatively lesser radius.

8. The engine block as set forth in claim 7 wherein said crankshaft pump portion further includes a plurality of said cam lobe distal surfaces and said cam lobe proximate surfaces.

9. The engine block as set forth in claim 8 wherein said integral pump further includes a pump actuator in sliding engagement with said cam lobe surface.

10. The engine block as set forth in claim 9 wherein said pump piston has a stroke.

11. The engine block as set forth in claim 10 wherein the stroke of the pump piston is equal to the difference between the relatively larger radius of the cam lobe distal surface and the relatively lesser radius of the cam lobe proximate surface.

12. The engine block as set forth in claim 11 wherein the integral pump further includes a pump housing having a pump cylinder wall therein.

13. The engine block as set forth in claim 12 wherein the pump piston is operably disposed in said pump cylinder wall for reciprocal operation therein.

14. The engine block as set forth in claim 7 wherein said integral pump is a pump unit.

15. The engine block as set forth in claim 14 wherein said pump unit further includes at least one pump unit.

16. The engine block as set forth in claim 15 wherein said pump unit further includes a reciprocally operable pump piston.

17. The engine block as set forth in claim 16 wherein said pump piston is reciprocally operable through a pump stroke.

18. The engine block as set forth in claim 17 wherein said pump unit further includes an inlet valve subassembly for permitting an intake of fluid.

19. The engine block as set forth in claim 18 wherein said pump unit further includes an outlet valve for permitting an outflow of pumped fluid from said pump unit.

20. The engine block as set forth in claim 14 wherein said pump includes a plurality of pump units.

21. The engine block as set forth in claim 20 wherein said pump units are radially disposed about the crankshaft pump portion.

22. The engine block as set forth in claim 21 wherein each said pump unit further includes a reciprocally operable pump piston.

23. The engine block as set forth in claim 22 wherein each said pump piston is reciprocally operable through a pump stroke.

24. The engine block as set forth in claim 23 wherein each said pump unit further includes an inlet valve subassembly for permitting an intake of fluid.

25. The engine block as set forth in claim 24 wherein each said pump unit further includes an outlet valve for permitting an outflow of pumped fluid from said pump unit.

* * * * *